US006206968B1

(12) United States Patent
Minges

(10) Patent No.: US 6,206,968 B1
(45) Date of Patent: Mar. 27, 2001

(54) APPARATUS FOR COATING PRODUCTS

(75) Inventor: Charles Mitchell Minges, Banner Elk, NC (US)

(73) Assignee: LIF Hospitality Mints LLC, Dallas, TX (US)

( * ) Notice: Subject to any disclaimer, the term of this patent is extended or adjusted under 35 U.S.C. 154(b) by 0 days.

(21) Appl. No.: 09/240,884

(22) Filed: Feb. 1, 1999

(51) Int. Cl.[7] ..... B05C 5/02

(52) U.S. Cl. ..... 118/683; 118/684; 118/696; 118/19; 118/20; 118/24; 118/303; 118/315; 118/320; 118/418

(58) Field of Search ..... 118/683, 684, 118/696, 19, 20, 24, 303, 315, 319, 320, 418

(56) References Cited

U.S. PATENT DOCUMENTS

| | | | |
|---|---|---|---|
| 1,504,423 | 8/1924 | Boneberg . | |
| 2,300,110 | 10/1942 | De Hoog . | |
| 2,388,662 | 11/1945 | Anderson et al. . | |
| 2,606,696 | 8/1952 | Miner . | |
| 3,980,209 | 9/1976 | Collar . | |
| 4,055,281 | 10/1977 | Rosen et al. . | |
| 4,514,093 * | 4/1985 | Coch et al. | 118/19 |
| 4,801,051 | 1/1989 | Lewis et al. . | |
| 4,826,050 | 5/1989 | Murphy et al. . | |
| 5,366,904 | 11/1994 | Qureshi et al. . | |

* cited by examiner

*Primary Examiner*—Laura Edwards
(74) *Attorney, Agent, or Firm*—Dowell & Dowell, P.C.

(57) ABSTRACT

A process and apparatus for coating a food, confectionery or pharmaceutical product wherein the product is prepared in rotary pans and wherein separate adjustable double piston metering pumps are used to automatically supply a coating substance to each pan on a predetermined schedule.

12 Claims, 3 Drawing Sheets

14
28
26
20
55
56
CHECK
VALVES
54
10
34
30
S
24
16
25
15
62
52
P
60
42
45
TIMER
48
50
70
40
36
32
44
P
RVD
M
PROGRAMMABLE
CONTROLLER
46

20
S
26
28
14
10
56
55
CHECK
VALVES
54
25
34
30
S
16
64
24
62
52
15
P
42
70
TIMER
32
40
60
36
P
RVD
M
PROGRAMMABLE
CONTROLLER
44
45
46
48
50

APPARATUS FOR COATING PRODUCTS

BACKGROUND OF THE INVENTION

1. Field of the Invention

This invention is generally directed to processes and devices utilized for coating products and especially sugar coatings to products including food, confectionery and pharmaceutical products and more specifically to adjustable double piston metering pumps which are used to supply a coating solution to rotating pans in which a product is retained and wherein the coating solution is supplied by the pumps on a predetermined schedule.

2. Brief Description Of The Related Art

The process and apparatus of the present invention may be utilized in substantially any coating of a food, confectionery or pharmaceutical product, however, the invention has been specifically developed for use in sugar panning processes wherein the product to be coated is contained in a revolving cylinder, referenced in the industry as a "pan". In sugar panning, numerous thinly applied layers of solution consisting of mixtures of sugar, water, corn syrup, various gums and coloring agents are applied to the product. Each layer or dosage of the coating solution is measured, applied to the product and allowed to "distribute" within the product before the product is dried using either hot or cold air, depending whether the coating process is a "Hot Process" or a "Cold Process". The number of layers or dosages applied is predetermined and the processes of coating continues successively until the predetermined number of coatings are applied to the product.

The process of applying liquid solution, allowing distribution time and subsequent drying is repeated numerous times until a desired appearance or size of the finished product is obtained. This may require from twenty to several hundred applications of the coating solution depending upon the particular product and the original intent for the panning of the product. Typically, confectionery items are coated with a crunchy candy shell which is usually colored, chocolate confections are coated to prevent melting and pharmaceutical products are made more palatable for consumer consumption.

Substantially all sugar panning is done in one of two types of equipment, conventional pans or automated pans. Automated pans are generally used by companies which specialize in panning in large mass utilizing batch processes of products in the one thousand to three thousand pound range. The pans are extremely large and the dosing functions are generally computerized such that the introduction of solutions, drying times and the like are automated. Automated pans are inherently more expensive than conventional pans and can easily cost in the hundreds of thousands of dollars.

Conventional pans are smaller and less expensive and process batch sizes from several pounds for laboratory uses up to several hundred pounds for commercial production models. The relatively small batch yield and inexpensive cost of conventional pans normally require that manufactures utilize a plurality of pans in series to accomplish coating tasks. Conventional pans are advantageous for processing multiple batches in various flavors and colors simultaneously.

Conventional pans are currently not automated for sugar panning. Dosing and control of drying air is done manually. Typically an operator proceeds from one pan to the next so as to control both the dosing and air supply to each pan in sequence. At each pan where the air is turned of, the coating solution is measured and poured into the revolving pan. The solution is allowed to distribute with the material to be coated before drying air is supplied. This process is repeated at each pan until the desired number of coatings is obtained. Unfortunately, extreme care must be taken so that the coating solution supplied to each pan is supplied not only in equal amounts but so that the amount of distribution time that the coating solution has with the product and the amount of drying time remains equal for all pans in a series of pans in order to provide a uniform product. A typical skillful operator may operate as many as fifteen pans in sequence.

In view of the foregoing, in the use of conventional sugar panning equipment, there is no method or apparatus for insuring uniformity of the coatings applied to products from one pan to the next and a great deal of reliance is placed upon the effective skills of an operator.

SUMMARY OF THE INVENTION

The present invention was developed in view of the shortcomings outlined above with respect to limitations of coating processes utilizing conventional panning equipment. The invention provides both a process and metering pump for automatically supplying, to each pan in a series of pans, a predetermined dose of coating solution at predetermined timed intervals so as to ensure uniformity between the quantity of coating solution introduced into each pan, uniformity at distribution time of the solution within each pan, and uniformity of drying time for each pan in a series of pans. To this end, the present invention includes a coating solution supply assembly which is adapted to be mounted adjacent a conventional pan for supplying predetermined quantities of coating solution to the pan at predetermined time intervals.

Each coating solution supply assembly of the present invention includes a unique pan pump formed as a double piston metering and supply pump. Each pump includes a first cylinder chamber having a first metering piston member mounted therein wherein the piston member is adjustable relative to a piston rod which extends through the cylinder. The piston rod moves with the metering piston from a first position for introducing a control fluid into the chamber defined thereby to a second position for discharging the control fluid from the chamber. This action simultaneously causes the discharge of a coating solution from a separate cylinder defining a food grade coating solution supply chamber. The piston rod extends through the first chamber and into the separate second coating solution supply chamber which receives the coating solution. The coating solution supply chamber is maintained spaced from the metering chamber so that the operating or control fluid for the pan pump never contacts the coating solution thus insuring the sterility of the coating solution which is pumped from a supply source to a distribution header. The distribution header is connected in fluid communication with an outlet of the coating solution supply chamber of the pan pump. The piston rod is also connected to a second piston mounted within the coating solution supply chamber.

As the first metering piston member is moved by a control fluid within the metering chamber, the piston in the coating solution supply chamber is first moved in a direction to draw a coating solution from a supply container through a one-way check valve and into the solution supply chamber of the pan pump. Once the metering piston has been moved to a fully open position such as by the introduction of a pneumatic source into the chamber of the metering cylinder, the metering piston is activated by the pneumatic source to drive the piston rod to force coating solution out of the chamber of the coating supply chamber through another one-way check valve and to the distribution header. The effective stroke of the metering piston is changed by moving the piston member relative to the piston rod such as by utilizing a threaded engagement between the metering piston member and the piston rod. The effective stroke may also be controlled by the supply of pneumatic air or other fluid to the metering chamber by an appropriate valve and controller.

To maintain the solution supply chamber clean and operative, a source of cleaning and lubrication solution and is connected to the coating solution chamber. Cleaning lubricating solution is periodically introduced into the chamber on an opposite side of the piston from the face of the piston which is in contact with the coating solution. The cleaning and lubricating solution may be recycled over a period of time.

The coating solution supply assembly is designed to be mounted on a standard or mobile support so as to be spaced adjacent to an opening to a conventional pan. The distribution header extends outwardly from the pan pump and into the pan and is provided with a plurality of nozzles for distributing a coating solution throughout the volume defined by the pan.

A controller is provided such that after a predetermined quantity of coating solution is introduced into a coating pan, drying air is not introduced into the pan until a predetermined residence time for the coating solution has been achieved. Thereafter, the controller activates the supply of either hot or cold air to the chamber allowing the coating to solidify as the pan rotates. After a predetermined time, the supply of drying air is terminated and a subsequent injection of coating solution is introduced into the pan. The cycle is repeated until a predetermined coating has been applied to the product.

It is the primary object of the invention to enable conventional sugar coating pans to be operated in an automated manner utilizing coating solution supply assemblies which are operable to supply a coating solution through a double piston pan pump in such a manner that the coating solution is introduced into a pumping, dispensing or injection chamber under conditions wherein the food grade solution is retained free from exposure to any elements which may otherwise contaminate the solution and wherein the quantity of solution may be easily adjusted by adjusting a separate metering piston which is remote from the food grade dispensing chamber.

It is a further object of the present invention to provide a method and apparatus whereby conventional sugar pans may be operated and supplied with coating solutions in a manner in which coatings are uniformly applied to products within the pans.

DESCRIPTION OF THE PREFERRED EMBODIMENT

Figure 1:
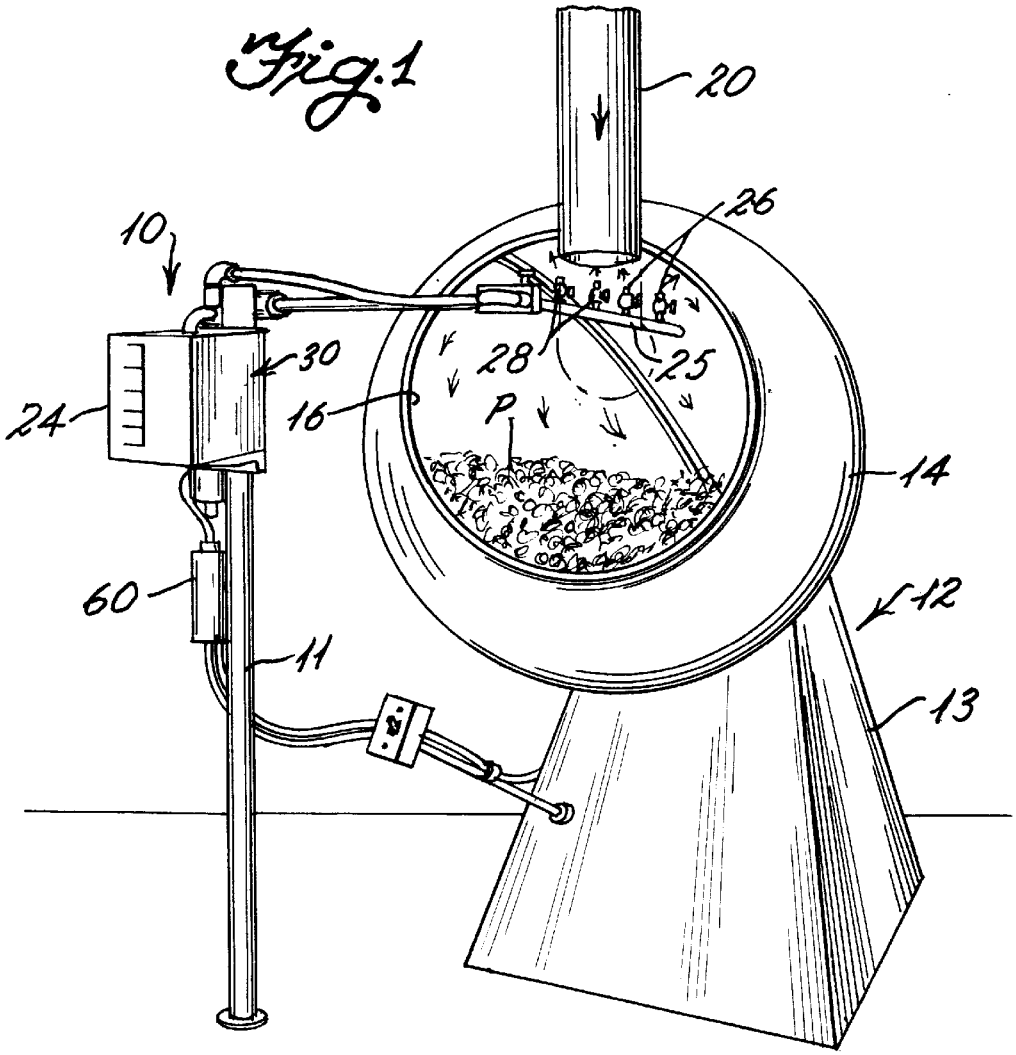
FIG. 1 is a front perspective illustrational view of a conventional sugar pan having a coating solution supply assembly mounted adjacent thereto in accordance with the teachings of the present invention.
Figure 2:
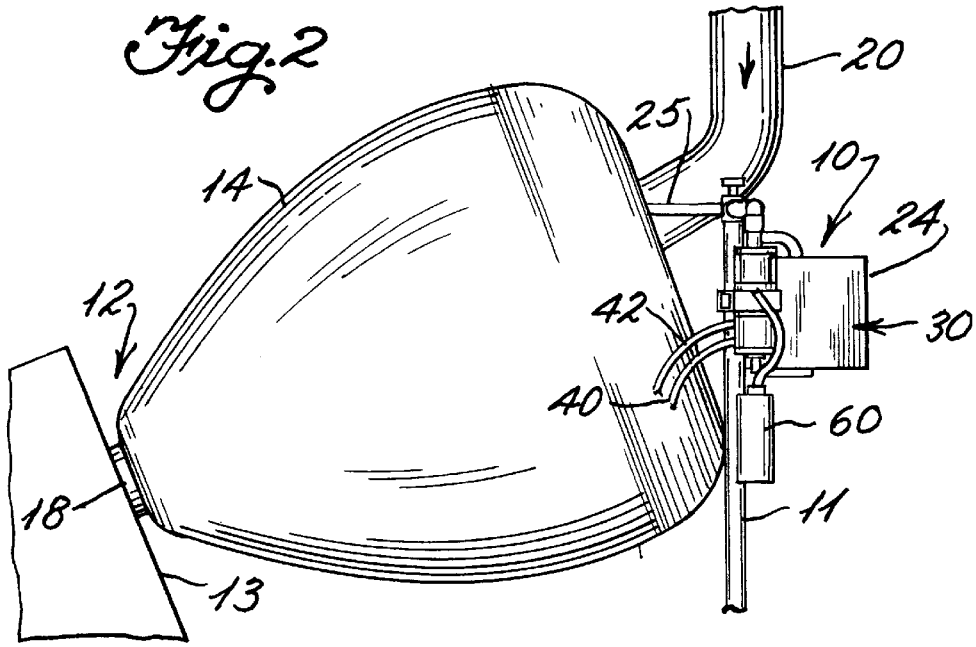
FIG. 2 is a partial side elevational view of the conventional pan and coating solution supply assembly of FIG. 1 showing in greater detail the components of the coating solution supply assembly of the present invention.
Figure 3:
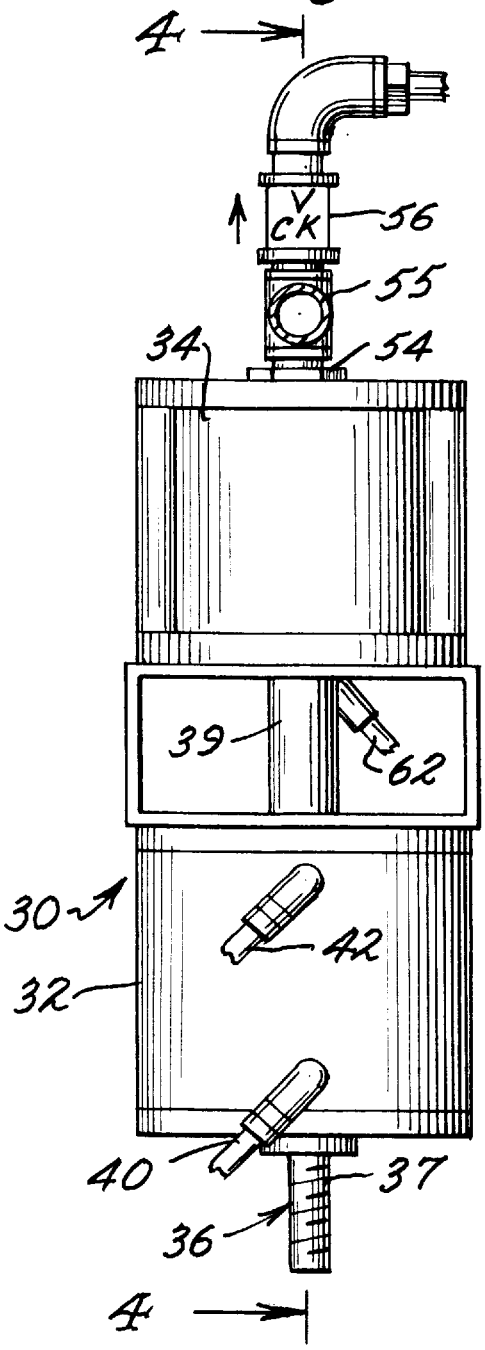
FIG. 3 is an enlarged side elevational view of the adjustable double piston metering pump utilized with the coating solution supply assembly of the present invention.

With continued reference to the drawing figures, the coating solution supply assembly 10 of the present invention is shown mounted to a standard or other support 11 adjacent to a conventional sugar pan unit 12. The sugar pan unit includes a base 13 to which is rotatable mounted a somewhat cylindrical pan 14 which is inclined such that the inner chamber 15 defined thereby is angled upwardly relative to the vertical such that product "P" is contained beneath an opening 16 and within the chamber of the pan. The pan 14 is a conventional coating pan of the type which may enable processing of anywhere up to several hundred pounds of product. The pan is mounted on a rotating shaft 18, FIG. 2, driven by a motor (not shown) mounted within the base 13.

Figure 5:
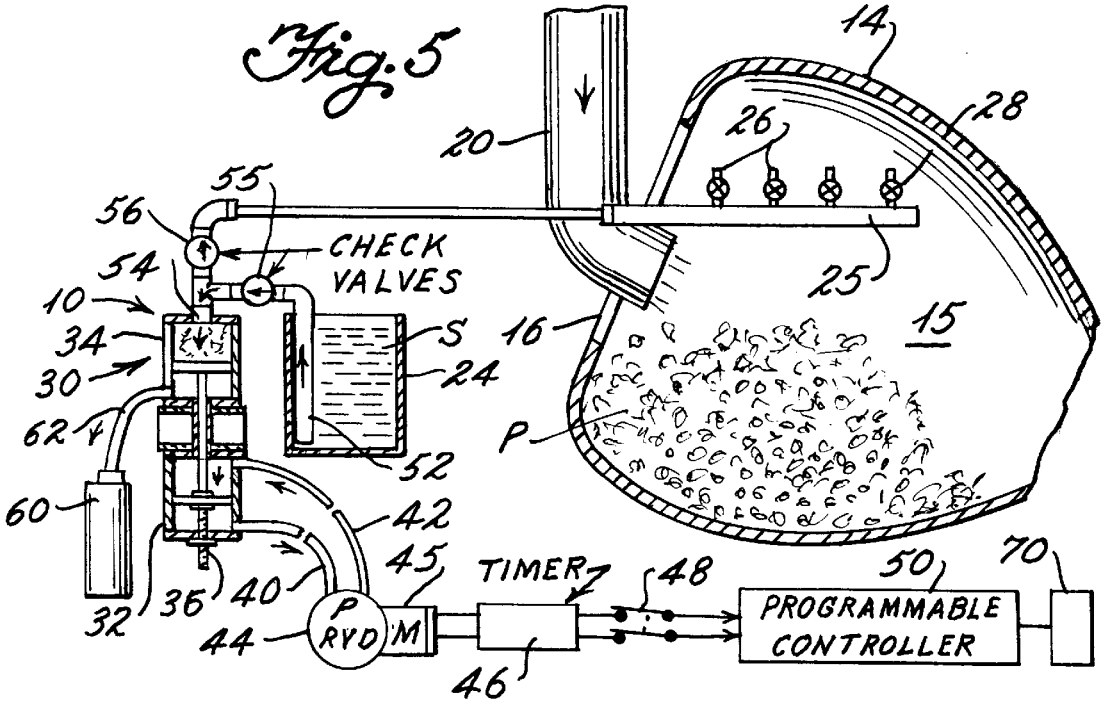
FIG. 5 is a cross sectional illustrational view showing the metering of a predetermined amount of coating solution into the coating solution pumping chamber of the pan pump during a time when drying air is being supplied to product within the coating pan.
Figure 6:
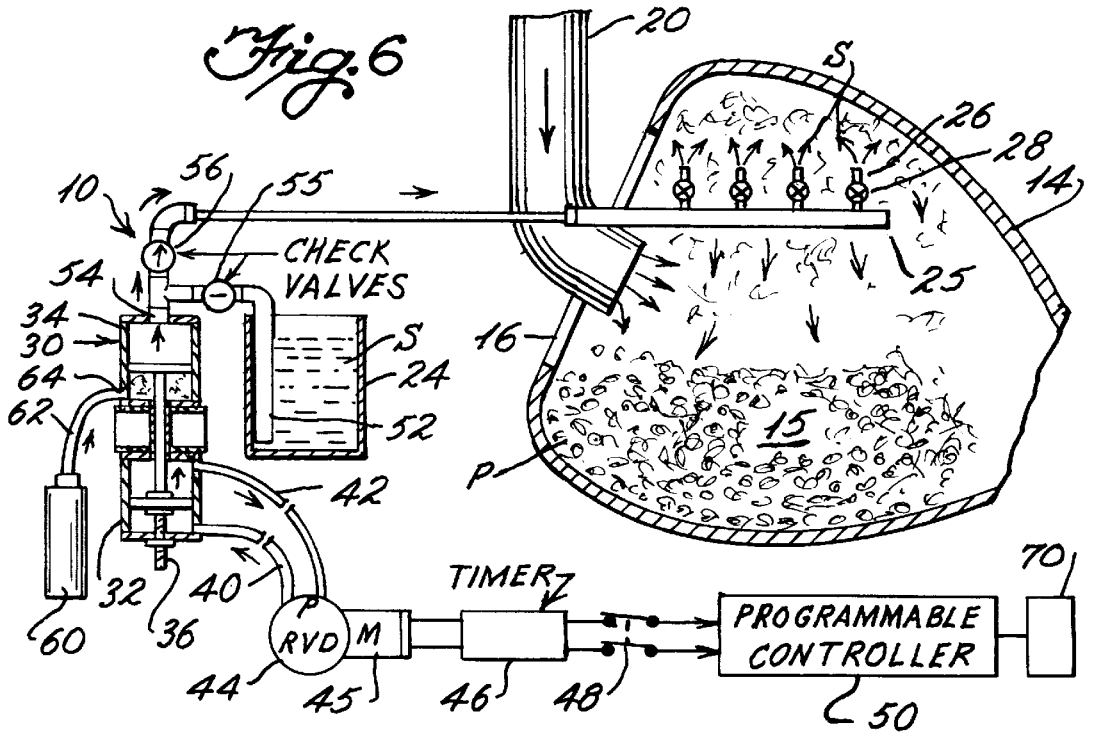
FIG. 6 is a view similar to FIG. 5 showing the termination of drying air to the pan and the introduction of the coating solution from the pan pump to the product within the rotary pan.

To harden the solution which is introduced into the pan 14, a drying air duct 20 is provided having a nozzle portion which extends into the chamber 15, as shown generally in FIGS. 5 and 6. The configuration of the drying duct and nozzle may be varied depending upon the coating process. Each duct is connected to a central source of either hot or cold drying air.

In the drawing figures, the coating solution supply assembly is shown as being mounted to a fixed standard 11. It should be noted that the assembly may also be mounted to moveable supports so that each assembly may be moved from one pan to another, as may be required, or so that the relationship between assemblies may be altered depending upon the environment in which the coating process is taking place.

Each coating solution supply assembly includes a coating solution supply container 24 in which a coating solution "S" is retained. The container may include appropriate markings to indicate the volume content of solution. The solution is withdrawn from the container 24 and pumped through a distribution header 25 which extends inwardly of the chamber 15 of the coating pan 14. The distribution header may include a plurality of spray or drip nozzles 26 which, in some embodiments, may include adjustable control valves 28. The metering and supply of the solution is controlled by a pan pump 30 which is mounted to the standard 11.

The pan pump 30 is a double piston metering pump including a metering chamber or cylinder 32 and a pumping or coating solution supply chamber or cylinder 34. A first metering piston 35 is mounted within the metering chamber 32 in such a manner that it may be adjustable relative to an elongated piston rod 36. In the drawing figures, the piston 35 is shown as being threadingly engaged with a threaded portion 37 of the piston rod 36 such that rotation of the piston rod relative to the piston will vary the effective stroke length of the piston 35 within the chamber 32. In this manner, the effective stroke length of a second piston 38 mounted within a pumping or coating solution supply chamber 34 is adjusted. The piston 38 is mounted to the upper end of the piston rod 36 such that the piston 38 and the piston 35 move simultaneously with one another. The piston rod extends through an elongated seal 39 which extends between the cylinders 32 and 34 so as to prevent contamination of the cylinder chamber 34.

The movement of the metering piston 35 is controlled by a pair of pneumatic lines 40 and 42 which extend through openings 43 and 44, respectively, into the chamber 32. Each of the pneumatic lines are connected to a solenoid valve 45 which controls an air supply to the lines. The valve is electrically connected to a controller 50 which is connected to an appropriate on-off switch 48. The controller 50 may be used to control the effective stroke and thus the quantity of solution which is to be pumped into the chamber 15 of the pan 14 during each pumping cycle of the pan pump 30 as well as to control the supply of drying air.

Figure 4:
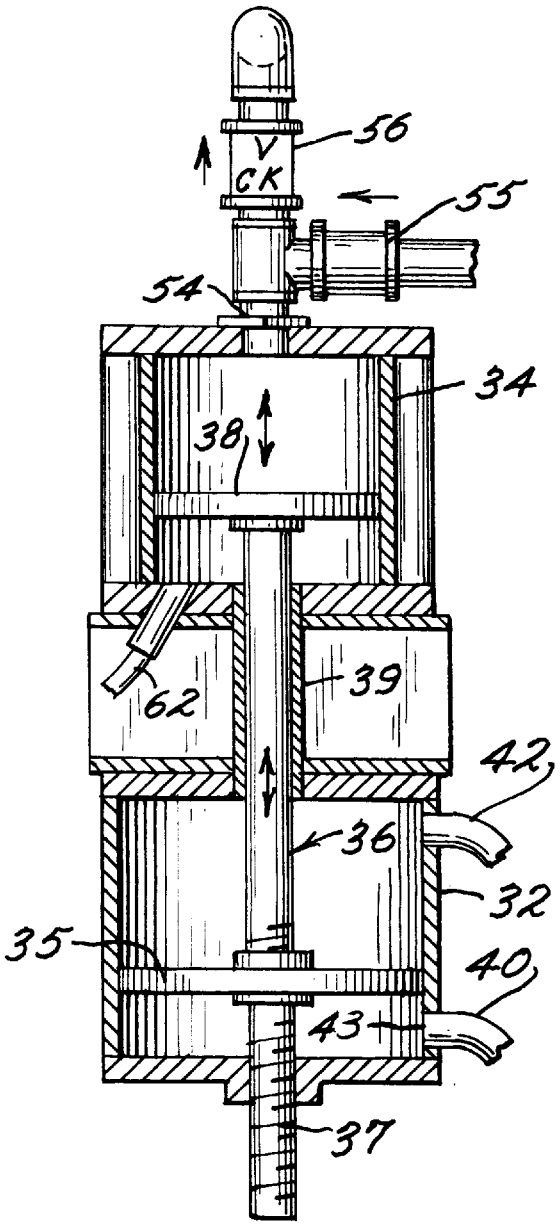
FIG. 4 is a cross-sectional view taken along line 4—4 of FIG. 3 showing the double piston members and double chambers of the pan pump of the present invention.

As shown in drawing FIGS. 4 and 5, a fluid inlet line 52 extends within the solution supply container 24 and is connected to an inlet 54 into the chamber 34 through a first one-way check valve 55. When the piston 38 is moved away from the inlet 54, a partial vacuum is created within the chamber 34 thus drawing the coating solution "S" from the container 24 and into the chamber 34. The stroke is effectively controlled by the metering piston 35 and its movement within the chamber 32. In FIG. 5, the piston 34 is being driven downwardly by a pneumatic source such as air supplied through pneumatic line 42. Air below the piston is bled from the lower portion of the chamber through pneumatic line 40 which functions as an exhaust line until the effective downward stroke of the piston 35 is achieved. At this point in time, the valve 45 is reversed thus driving air through the pneumatic line 40 and moving the piston 35 upwardly and thus moving the piston 38 upwardly so as to discharge solution "S" from within the coating solution supply chamber 34. The solution is prevented from entering the container 24 because of the one way check valve 55. The discharging fluid passes through a second one-way check valve 56 and into the distribution header 25 wherein the solution is introduced within the chamber 15 by way of the nozzles 26.

As previously discussed, the effective amount of coating solution can be controlled not only by predetermining the position of the piston 35 within the chamber 32 but also by varying the effective stroke length of the piston 35 by way of air supplied to the metering chamber 32. Pumping of the solution from the chamber 34 is illustrated in drawing FIG. 6.

Also shown in FIGS. 5 and 6 is a source of lubricant and cleansing agent which is introduced in a cyclic manner into the lower portion of the solution pumping chamber 34. The solution is contained within an enclosed container 60 which is connected by supply line 62 through an inlet opening 64 in the side wall of the chamber 34. The fluid may be a vegetable oil type fluid which is utilized to provide both a lubricant source within the pumping chamber as well as a cleansing source.

It should be noted that as opposed to applying a single outlet 54 from the pumping chamber 34, a separate inlet may be provided for drawing solution "S" from the container 24 through check valve 55 into the chamber 34 and a separate outlet may be provided to which the check valve 56 is connected so that fluid is discharged through the separate outlet to the distribution header 25.

Utilizing the apparatus of the present invention, the controller 50 is utilized as a timer. An initial determination is made to set the position of the metering piston 35 relative to the piston rod 36. The controller 50 also includes a connection to a drying air controller 70. Whenever solution is being introduced into the chamber 15 of the pan 14, the dryer is normally deactivated so as to allow a predetermined residence or distribution time of the solution within the product "P" prior to drying air being introduced to affect drying.

Utilizing the pan pump 30 of the present invention, no contamination of the coating solution is possible as the metering is effectively accomplished in the lower portion of the pan pump with the metering piston 35 operating within the metering chamber 32. Therefore, the sterility of the coating solution is maintained throughout the coating process.

Utilizing the present invention, uniform quantities of solution are introduced into the pans 14 and the distribution time of the solution within the product and the drying time is accurately assured thereby insuring uniformity of the coated product from one pan to another.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. An adapted for use in supplying doses of a coating material to products retained in a coating pan comprising, a pan pump means, means for supporting said pan pump means relative to said coating pan, a coating solution container, said pan pump means including a metering cylinder and a solution dispensing cylinder, a first metering piston mounted within said metering cylinder to a piston rod, means connected to said metering cylinder for moving said first piston between a first position and a second position within said metering cylinder, said piston rod extending into said solution dispensing cylinder and supporting a second piston member, means for connecting said solution dispensing cylinder to said coating solution container such that as said metering piston is moved from a first position to a second position said second piston is moved from a first position to a second position drawing coating solution into said coating dispensing cylinder, a coating solution injector adapted to introduce coating solution into said coating pan, and means for connecting said injector to said solution dispensing cylinder such that coating solution within said solution dispensing cylinder is urged from said solution dispensing cylinder and through said solution injector as said metering piston is moved from said second position toward said first position thereby moving said second piston from said second position toward said first position thereof.

2. The apparatus of claim 1, including at least one seal means disposed about said piston rod and positioned between said metering cylinder and said solution dispensing cylinder.

3. The apparatus of claim 1, including means for introducing a lubricant into said solution dispensing cylinder.

4. The apparatus of claim 1 in which said means for connecting said coating solution container to said solution dispensing cylinder includes a first check valve for preventing a reverse flow from said coating solution dispenser cylinder to said coating solution container.

5. The apparatus of claim 4 in which said means for connecting said injector to said solution dispensing cylinder includes a check valve for preventing coating solution from flowing therethrough when said second piston is moved from said first to said second position thereof.

6. The apparatus of claim 5, including means for adjusting said metering piston relative to said piston rod to thereby effectively adjust the stroke of said metering piston within said metering cylinder.

7. The apparatus of claim 1, including means for adjusting said metering piston relative to said piston rod to thereby effectively adjust the stroke of said metering piston within said metering cylinder.

8. The apparatus of claim 1, including means for controlling the movement of said metering piston between said first and second positions thereof to thereby control a quantity and timing of delivery of coating solution from said solution dispensing cylinder.

9. The apparatus of claim 8, further including means adapted to introduce drying air into the coating pan, and means for sequentially activating said means for supplying drying air to said coating pan.

10. The apparatus of claim 1, in which said means for moving said metering piston between said first and second positions thereof includes a pair of pneumatic lines having spaced fluid inlets into said metering cylinder.

11. A apparatus for use in supplying a coating material to products retaining in a coating pan comprising, a pan pump means, means for supporting said pan pump means relative to a coating pan, said pan pump means including first and second pump chambers which are spaced in sealed relationship with respect to one another, said first pump chamber functioning as a metering pump and said second pump chamber functioning as a dispensing pump and wherein said dispensing pump is controlled by operation of said metering pump, a coating solution supply, means for connecting said coating solution supply to said dispensing pump and means for connecting said dispensing pump to an injector adapted to introduce coating solution into the coating pan, and means for regulating said metering pump for regulating a volume of coating solution to be dispensed from said dispensing pump and for regulating intervals between subsequent dispensing of coating solutions from said dispensing pump.

12. An apparatus for use in supplying a coating material to products comprising, a coating pan, a pan pump means, means for supporting said pan pump means relative to said coating pan, said pan pump means including first and second pump chambers which are spaced in sealed relationship with respect to one another, said first pump chamber functioning as a metering pump and said second pump chamber functioning as a dispensing pump and wherein said dispensing pump is controlled by operation of said metering pump, a coating solution supply, means for connecting said coating solution supply to said dispensing pump and means for connecting said dispensing pump to an injector mounted so as to introduce coating solution into said coating pan, and means for regulating said metering pump for regulating a volume of coating solution to be dispensed from said dispensing pump and for regulating intervals between subsequent dispensing of coating solutions from said dispensing pump.

* * * * *